United States Patent [19]

Hesch et al.

[11] Patent Number: 4,864,938

[45] Date of Patent: Sep. 12, 1989

[54] RAILWAY FREIGHT CAR

[75] Inventors: Harold E. Hesch, St. John; Phillip G. Przybylinski; Robert P. Sellberg, both of Schererville, all of Ind.

[73] Assignee: Trinity Industries, Inc., Dallas, Tex.

[21] Appl. No.: 139,221

[22] Filed: Dec. 29, 1987

Related U.S. Application Data

[63] Continuation of Ser. No. 145,175, Oct. 28, 1987.

[51] Int. Cl.[4] ..... B61D 17/04

[52] U.S. Cl. ..... 105/4.1; 105/411; 105/421; 105/416; 410/52

[58] Field of Search ..... 105/3, 4.1, 411, 404, 105/413, 414, 410, 416, 418, 419, 420, 421, 422, 425; 410/44, 52, 78, 90, 94

[56] References Cited

U.S. PATENT DOCUMENTS

| | | | |
|---|---|---|---|
| 2,242,727 | 5/1941 | Meyer | 105/419 X |
| 3,207,086 | 9/1965 | Mowatt-Larssen et al. | 105/368 |
| 3,295,465 | 1/1967 | Borger | 105/414 X |
| 3,527,171 | 9/1970 | Stark | 105/416 X |
| 3,577,933 | 5/1971 | Ferris et al. | 105/422 X |
| 3,616,764 | 11/1971 | Johnson et al. | 105/366 |
| 3,721,199 | 3/1973 | Hassenauer | 410/77 |
| 4,194,451 | 3/1980 | Dehner | 105/416 |
| 4,274,776 | 6/1981 | Paton et al. | 410/57 |
| 4,665,834 | 5/1987 | Van Iperen | 105/4.1 |
| 4,686,907 | 8/1987 | Wollam et al. | 105/4.1 |

*Primary Examiner*—Johnny D. Cherry
*Assistant Examiner*—Frank H. Williams, Jr.
*Attorney, Agent, or Firm*—Myers & Ehrlich, Ltd.

[57] ABSTRACT

A railway car comprises a center sill with a crossbearer, webs and end bolsters extending across thereof. A light side stiffener interconnects the projecting ends of said webs and spans between the bolster and the crossbearer. A shear plate covers a trapezoidal end frame extending from the bolster. The frame includes inclined braces buttressing a pair of cantilevered brackets projecting toward and horizontally overlapping similar brackets of the adjacent car.

7 Claims, 4 Drawing Sheets

RAILWAY FREIGHT CAR

This application is a continuation of the U.S. patent application of Harold E. Hesch, Phillip G. Przybylinski, and Robert P. Sellberg filed Oct. 28, 1987, having Ser. No. 114,175 and entitled "RAILWAY FREIGHT CAR."

BACKGROUND OF THE INVENTION

This invention pertains to railroad cars and more particularly to a structure of a freight spine car.

Spine cars carry freight containers mounted on a spine-like car platform. A spine car generally includes a center beam with a series of parallel crossbearers extending transversely of the beam.

The containers are generally detachably secured on a spine car by container locks on crossbearers or bolsters on the car. These locks receive vertical loads for the weight of the containers. The locks also receive impact loads in a horizontal plane in resisting the tendency of a container to slide off the car during acceleration, deceleration, or cornering of the car.

Weight of a railway car is at a great premium, and reducing weight is an important goal of railway car design. To reduce weight by reducing the number of wheeled trucks needed in a railway car train, it is well known in the prior art to provide an articulated connection between two cars wherein an end of each car is pivotally supported on a truck. To limit tilt of the car with respect to the truck, the cars are usually provided with side bearing arms extending over the truck laterally outward of the pivotal connection. The side bearing arms contact bearings on the truck, preventing significant tilting of the car with respect to the truck.

However, no spine car is presently available which supports containers while taking advantage of the use of articulation between cars, and more particularly provides an efficient railway car structure for bearing horizontal impact loads from container locks and loads from side bearing arms.

Various spine cars heretofore disclosed are exemplified in the following patents. U.S. Pat. No. 3,616,764, issued to Johnson et al., shows a railway container car including a pair of I-beam side sills and a boxlike center sill interconnected by an angled cross member. Another U.S. Pat. No. 4,274,776, issued to Paton et al., teaches a container railcar with a depressed midsection and a four point truck suspension.

SUMMARY OF THE INVENTION

Accordingly it is an object of this invention to provide an articulated spine car for the transport of containers.

It is a further object of this invention to provide an efficient end structure for such a spine car.

In the spine car of this invention, the side bearing arms of the articulated end frame structure are supported laterally outwardly from the center sill of the car by a transverse end sill and a longitudinally inward transverse bolster. The bolster extends laterally outward beyond the side bearing arms to support container locks at the lateral sides of the car. A diagonal beam is connected to the bolster adjacent a respective container lock and to the side bearing arm to form a truss structure to support the container loads, including torsional loads created in the bolster by longitudinal impact loads at the container locks. The end frame structure is additionally reinforced by a shear plate attached over the end frame structure to aid in bearing lateral shear loads from longitudinal impact loads.

DESCRIPTION OF THE PREFERRED EMBODIMENT

Figures 1, 2, 3:
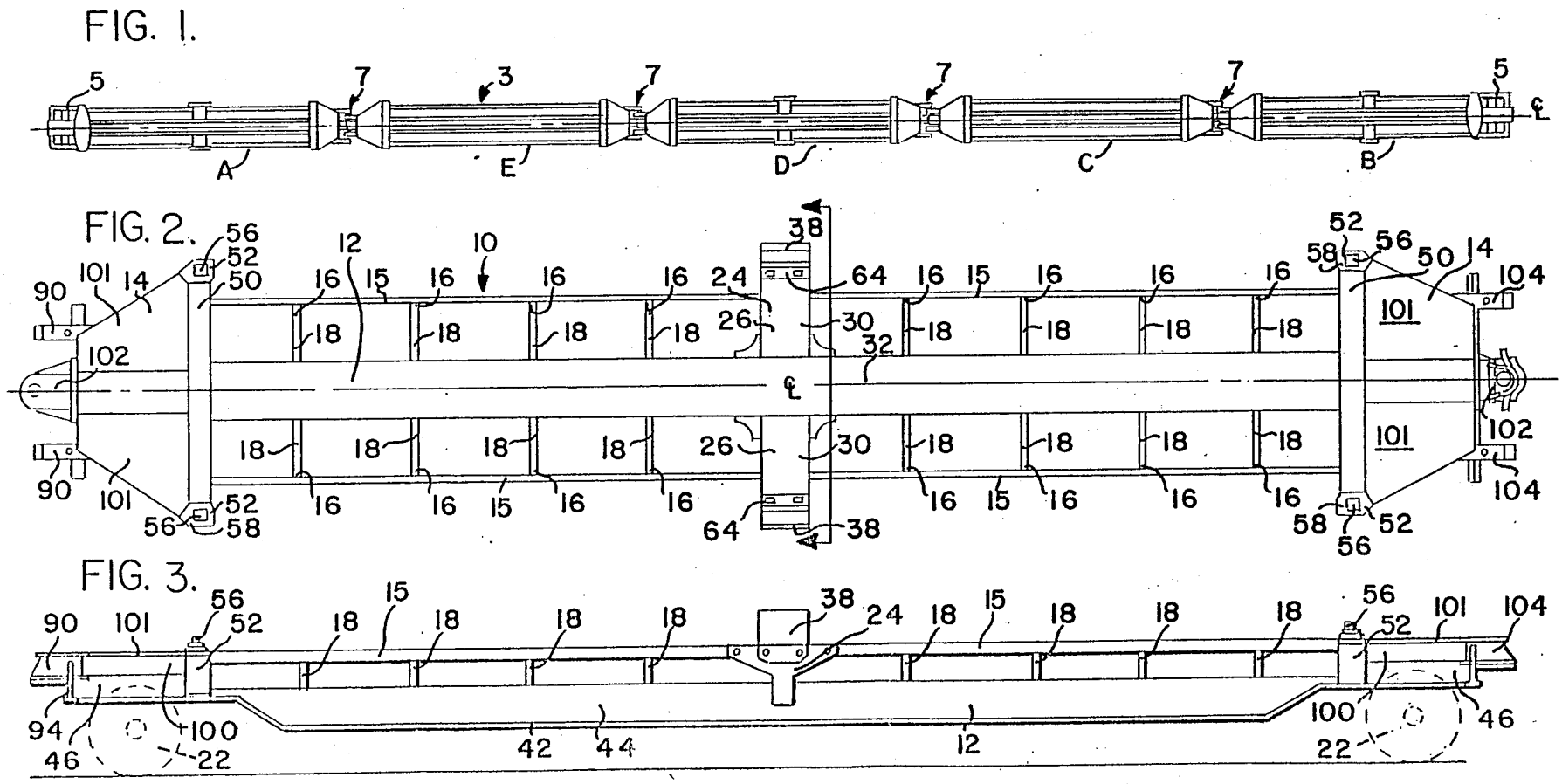
FIG. 1 is a schematic top view of a train of articulated spine cars of the invention.
FIG. 2 is a top view of an intermediate spine car in the train.
FIG. 3 is a side view of the spine car shown in FIG. 2.

FIG. 1 shows a schematic plan view of a train 3 formed of five serially connected articulated spine cars. It would be understood that articulated trains may have varying numbers of cars, ranging from a two car train having two cars articulatedly connected to each other to a train having considerably more than five cars.

In the five-car train embodiment shown in FIG. 1, a first end car A is provided with a coupler connection end 5 for connection with a conventional coupler railway car (not shown). The opposite end of the first end car A is connected with an end of intermediate car E to form an articulated connection 7. Intermediate cars E, D, C, and B are serially connected by articulated connections 7. End car B has a coupler connection end for connection to a second conventional coupler railway car (not shown).

FIG. 2 shows a car 10 which is exemplary of the intermediate cars C, D, and E. The car 10 includes a longitudinally extending center sill 12. A pair of end frame structures 14 are supported on the center sill 12 at the car ends to facilitate articulated interconnection between the cars. Light side sills 15 extend longitudinally between the end frame structures 14. The side sills 15 are connected to the lateral ends 16 of intermediate crossbearers 18. The adjacent ends of cars share a common double-axle swivelable truck 22 (shown in phantom lines). The articulated connections shorten the length of the train and reduce cost and weight by reducing the number of trucks needed.

A central load bearing crossbearer assembly 24 located in the middle of the car transfers loads in the side sills 15 laterally inward to the center sill 12. The crossbearer assembly 24 includes a pair of section crossbearers 26 each of which has a pair of generally triangular sections 28 rigidly secured to the center sill 12. A top plate 30 covering the crossbearer 26 is connected with the center sill top wall 32, and with the triangular sections 28 and bottom plate 33 forms a box-like structure extending laterally from the center sill 12. The lateral ends 34 of the crossbearers 26 each support a container guide or support shoe structure 38. The box-like crossbearers 26 act as torque tubes to transmit impact loads in the shoes 38 to the center sill 12.

The center sill 12 has a top wall 32, bottom wall 42 and a pair of side walls 44. The center sill height is decreased adjacent the longitudinal ends 46 thereof, shown in FIG. 4, to accommodate mounting of the car 10 on the respective trucks.

Bolsters 50 extend laterally outwardly from the center sill 12 adjacent the longitudinal ends of the car 10. Each of the bolsters 50 supports container support structures 52 secured to upper flange 54 of the bolster 50. Containers (not shown) deposited on the car are secured to anchors or mounts indicated schematically at 56 to prevent undesirable displacement of the containers during the train movement. These anchors 56 may include one of a variety of container securement structures such as a T-shaped, eyelet or hooklike structure attached to corner plate 58 carried by the bolster 50.

A series of parallel crossbearers 18 are welded to the top portion of the center sill 12 and the channel-shaped side sills 15. Crossbearer 18, side sills 15, crossbearer 26, and bolsters 50 form a grid supporting the load and absorbing forces applied to the car in the event that the structure of the container should sag below the container mounts. The top flange or plate 32 of the center sill 12 and top portions 54 of bolsters 50, crossbearer 26, webs 18 and side sill top flange 62 lie substantially in one plane.

The car 10 is configured to receive thereon a single container between 40 and 48 feet in length, or two 20-foot containers. When two 20-foot containers are placed on the car, each container has one end secured to the anchors 58 on a respective bolster 50. The opposite end of each container rests on pad 64 on crossbearer 24, and is secured against lateral movement by container guides or shoes 38 engaging the lateral side of the end of each container. To support the lateral loads, guiding shoes 38 are provided with a vertical face panel 65 and a brace portion 66.

The channel-shaped side sills 15 may be replaced by box-like or I-beam structures which would increase the car weight. The use of light upright channels reduces the car weight without losing the effectiveness of the car operation. The light side sills 15 rigidity the car grid and participate in the container weight distribution among other supporting members. The side sills span between and abut the crossbearer sections 28 and are connected with plates 67 supported on the container support structures 52 on a pair of channel-like stiffeners 70 attached to the center sill side walls 44 run on both sides thereof through the cut-off opening 72 in the crossbearer sections 28.

Figure 6:
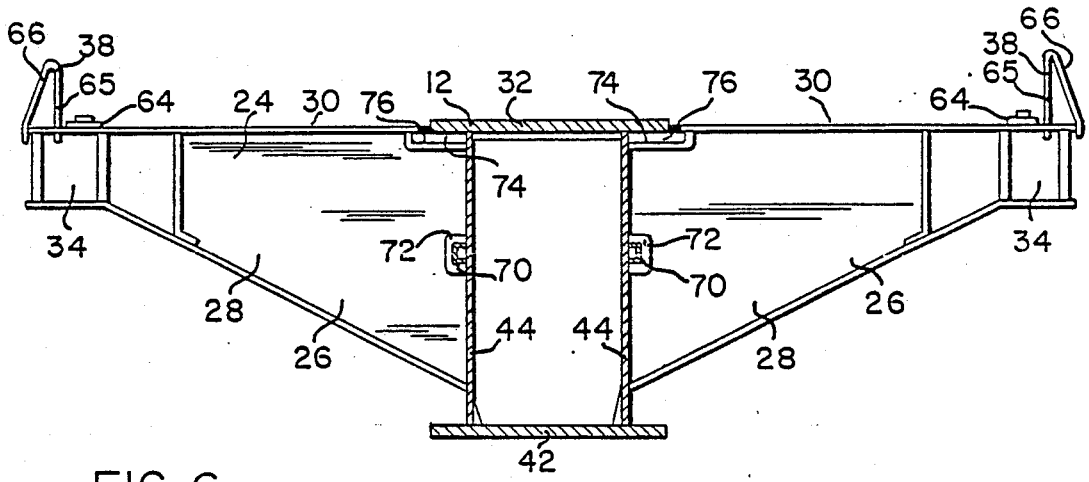
FIG. 6 a cross-sectional view taken substantially along the line 1—1 of FIG. 2.
Figure 7:
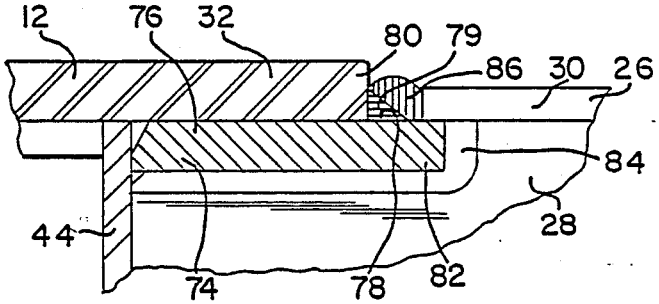
FIG. 7 is an enlarged detail view of the center crossbearer shown in FIG. 6 and shows the connection of the top of the crossbearer to the center sill top flange.
Figure 8:
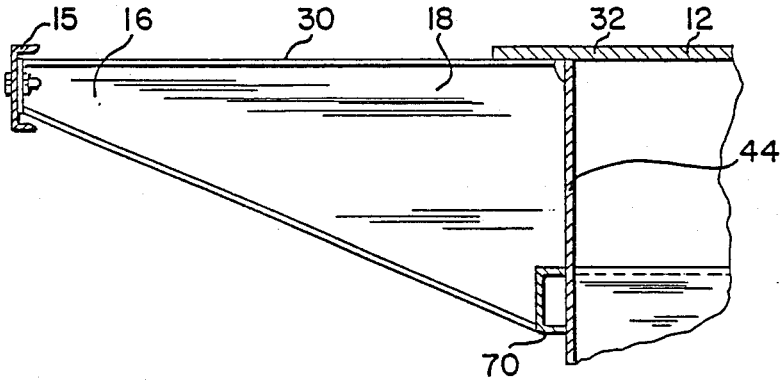
FIG. 8 is an enlarged view of an intermediate crossbearer and its attachment to the center sill.

A method of attachment of a crossbearer 28 or a web 18 to the center sill 12 is illustrated by FIGS. 6 and 7. A portion 74 of a metal mount plate 76 is welded to the center sill top plate 32 and the sill side wall 44. Then the top surface 78 of the plate 76 secured by a filet weld 79 to the edge 80 of the sill top plate 32. A cantilevered portion 82 of the mount plate 76, extends outwardly from top plate 32 and supports a top plate 30 of the crossbearer 24 during assembly. The crossbearer top plate 30 projecting above a cut-out corner 84 of the crossbearer 28 slides on the mount plate portion 82 during assembly and rests thereon while the top plate 32 of the center sill 12 is welded to top plate 30 of crossbearer 24 by butt weld 86, which provides a structure well suited to bearing the generally tensile forces in the upper plate 30 to upper plate 32 of the center sill 12. The cut-out portion 84 in the body of the crossbearer follows a contour of the mount plate.

Figure 4:
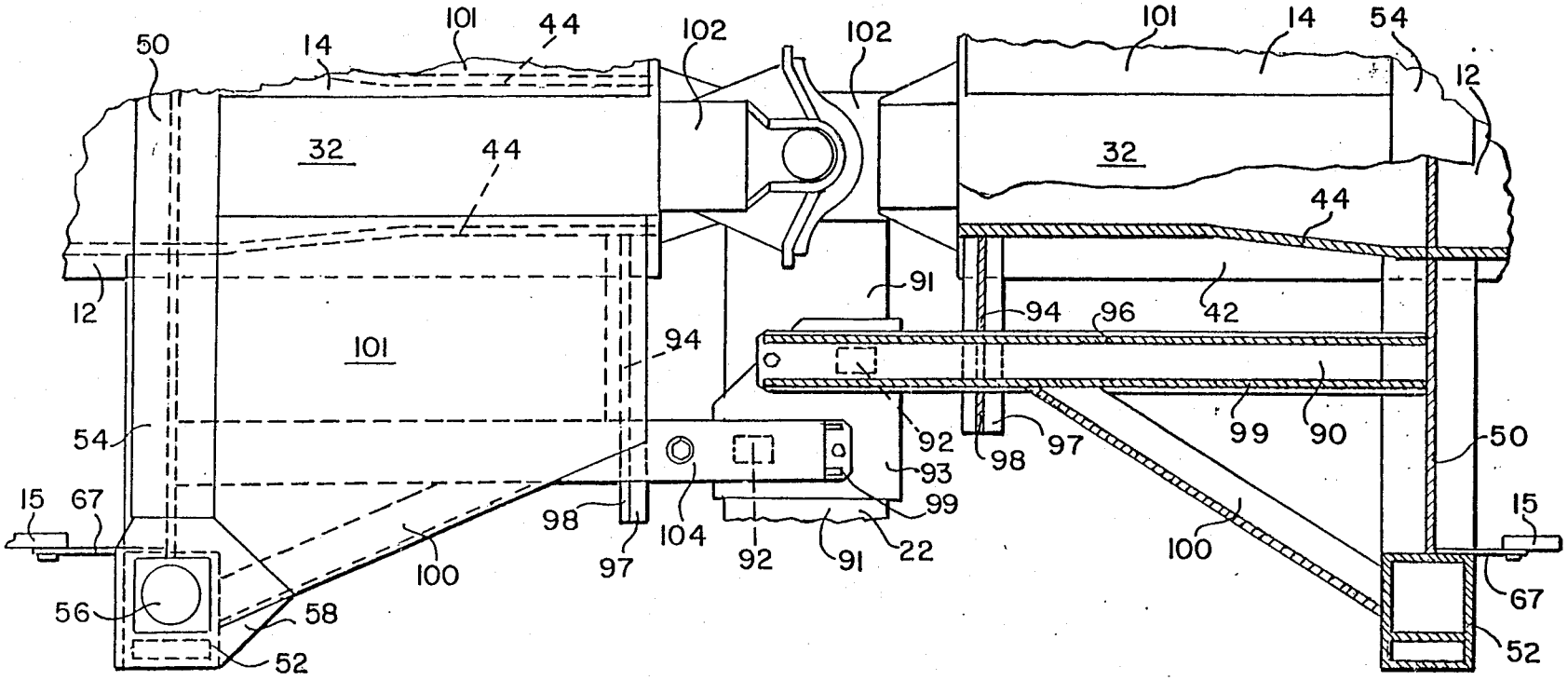
FIG. 4 is a top view of the articulated connection structure with the shear plate and articulation partially cut-away to show the supporting end frame structure.
Figure 5:
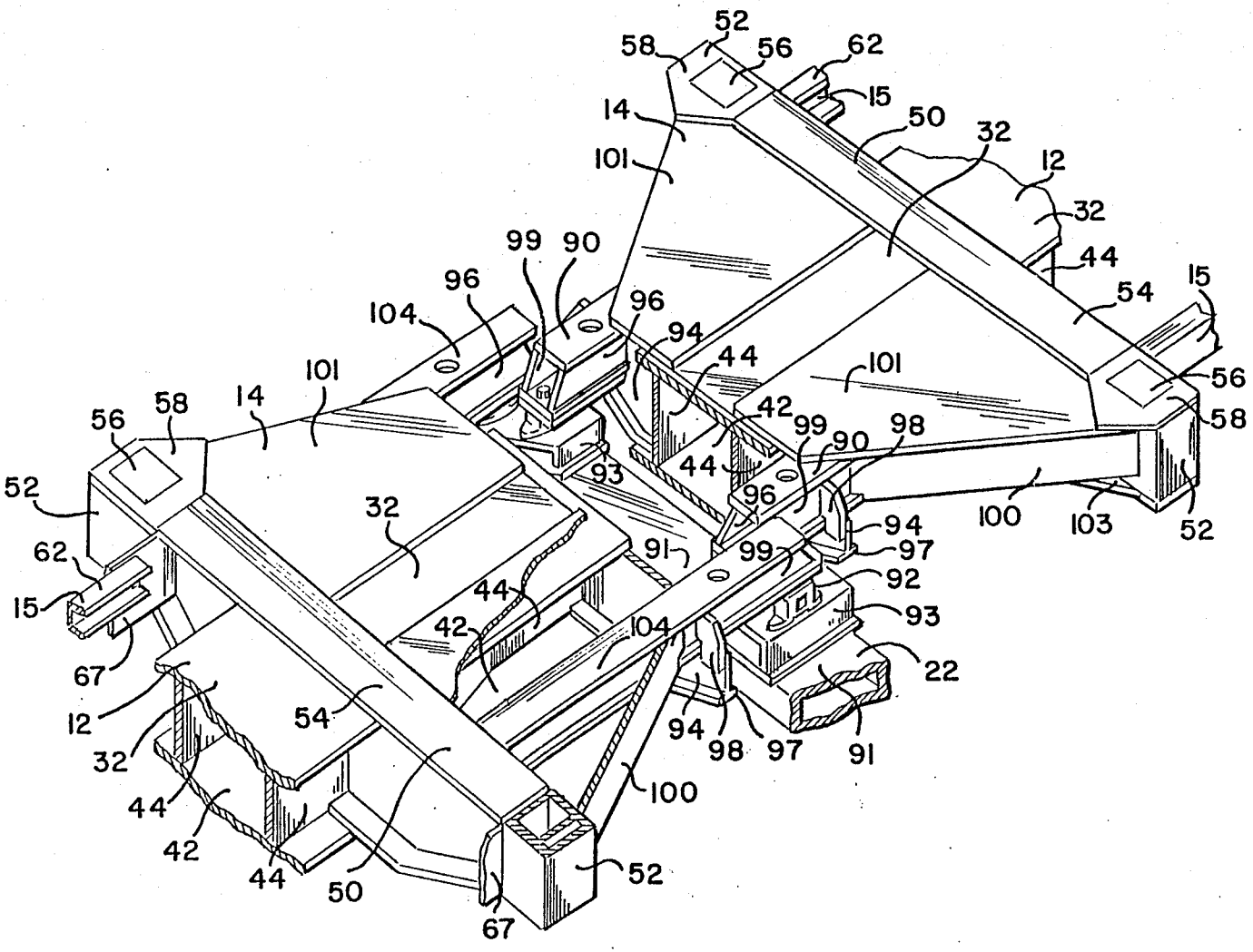
FIG. 5 is a perspective view of an embodiment of the articulated connection structure between two spine cars.

The end frame structure 14, best shown in FIGS. 4 and 5, includes a pair of parallel brackets or side bearing arms 90 cantilevered to extend longitudinally outward from the bolster 50. Brackets 90 extend above the body 91 of the truck 22. Each bracket 90 has a wear plate connected with its lower wall. Each wear plate engages respective bearings 92 on support structures 93 on the truck body 91 to limit tilt of the car with respect for the truck 22.

Each wear plate is secured to the bracket 90 by fasteners such as bolts connecting with the lower wall of the bracket 90. An opening is provided in the top wall of the bracket 90 which opening is substantially directly above the longitudinally inward fastener to provide access thereto for replacement of the wear plate. The tube-like brackets 90 have a generally rectangular cross-section.

The end sill or frame enclosure member 94 covers the end of the car and extends between the walls 44 of the center sill 12 and the inward side walls 96 of brackets 90. The frame enclosure member 94 includes a lower flange 97 which extends below the bracket 90 to support member 98 engaging the outer wall 99 of the brackets 90 as shown in FIG. 5.

Diagonal braces 100 are provided extending between brackets 90 and container support structures 52 on bolster 50. Braces 100 may be angle or channel members, or be beams of a variety of configurations. Braces 100 form a truss structure with brackets 90 which supports brackets 90 and stiffens shear plate 101, beaming impact loads received at the container support structure 52 to the end wall 94 and to the center sill 12. The loads include torsional loads in the bolster 50 created by the longitudinal container impact loads being applied at the container mounts 56 above the center of the bolster 50.

The container support structure 52 is vertically deeper then the brace 100. To enhance load transfer therebetween, a sloping member 103 extends between the bottom plate of the container support structure and the brace 100.

The shear plate 101 is welded to the center sill top plate 32, the end sills 94, the bolster 50, the brackets 90, and the braces 100 and serves to transfer the longitudinal impact loads at the lateral ends of the bolster 50 laterally inward to the center sill 12, and to reinforce the frames defined by these members. The shear plates 101 cover and reinforce the trapezoidal frames formed by the diagonal braces 100, enclosure member and bolster 50, and center sill 22. The trapezoidal frames taper longitudinally outwardly to the brackets 90.

The hollow brackets 90 and a center sill end 46 project outwardly of the end frame 20. The end 46 carries either a female or male part of an articulated connector 102. The brackets 90 of one car project into the space defined by the opposing brackets 104 on the adjacent car. Each intermediate car has a narrowspaced set of brackets 90 at one end and a wide-spaced set 104 at another. The end frame structure supporting the narrow-spaced brackets 90 and the wide-spaced brackets 104 is essentially the same.

The above described arrangement permits greater articulation of the adjacent cars, reinforces the rigidity of the end frame structure, and decreases the weight of the car by eliminating the corners of conventional and frames having a rectangular configuration. Still another advantage is that the trapezoidal end frames better withstand angular and shear forces applied to the moving car. The shear plates distribute the dynamic buff and draft loadings between the bolster 50 and the center sill 12.

Another advantage of the subject invention is that the side sills are light channel-like stiffeners interconnecting the ends of the crossbearers. The center sill is reinforced with longitudinal side stiffeners which also serve to support the connection of the intermediate crossbearers to the center sill.

The parallel webs or ribs mounted near the top of the center sill serve as braces. The side sill is attached to the crossbearer and the bolsters in an area located between the center sill and the outer ends of the crossbearer and bolsters.

While one embodiment of the invention has been illustrated and described herein, various changes and modifications may be made therein without departing from the spirit of the invention as defined by the scope of the appended claims.

What is claimed is:

1. A railway freight car comprising:

a pair of railway trucks rollingly supported on rails;

a first car body including:

a generally longitudinally extending center sill being supported on said trucks and having two opposite longitudinal ends;

a pair of longitudinally spaced end structures each supported adjacent a respective end of the center sill;

said end structures each comprising a bolster structure extending laterally outwardly from the center sill, said bolster structures each having container securement means thereon for securing a container on said railway freight car for transport, said container securement means being spaced laterally outwardly from the center sill;

a pair bearing arms flanking said center sill and spaced laterally thereof and projecting longitudinally outwardly from the adjacent end of the car and having inner ends connected to the adjacent bolster structure, and a pair of braces extending from opposite ends of the adjacent bolster structure and converging toward the respective adjacent end of the center sill and connected to respective bearing arms at a juncture intermediate the ends thereof.

2. A railway freight car comprising:

a pair of railway trucks rollingly supported on rails;

a first car body including:

a generally longitudinally extending center sill being supported on said trucks and having two opposite longitudinal ends;

a pair of longitudinally spaced end structures each supported adjacent a respective end of the center sill;

said end structures each comprising a bolster structure extending laterally outwardly from the center sill, said bolster structures each having container securement means thereon for securing a container on said railway freight car for transport, said container securement means being spaced laterally outwardly from the center sill;

a pair bearing arms flanking said center sill and spaced laterally thereof and projecting longitudinally outwardly from the adjacent end of the car and having inner ends connected to the adjacent bolster structure, and a shear plate member connected with said bolster structure adjacent said securement means and extending outwardly from the bolster structure, said shear plate member being connected with said center sill for transferring longitudinal impact loads laterally inward from the container securement means to the center sill, and one of said structures further comprising a brace member connected with the bolster structure adjacent the end thereof proximate the container securement means and with the shear plate member reinforcing the bolster structure and the shear plate member for transferring impact loads to the center sill, said brace member secured to the adjacent bearing arm intermediate the ends thereof.

3. The invention according to claim 2, and a second car body being supported on one of said railway trucks adjacent said one of said end structures to form a articulated unit with said first car body.

4. The invention according to claim 3, and said truck having bearing means thereon;

said bearing arms engaging said bearing means for limiting tilt of the first car body with respect to the truck.

5. The invention according to claim 2, and a grid structure extending between the end structures for supporting the container in the event that the container sags below the container securement means.

6. The invention according to claim 1 and a shear plate member connected with said bolster structure adjacent said securement means and extending outwardly from the bolster structure, said shear plate member being connected with said center sill for transferring longitudinal impact loads laterally inward from the container securement means to the center sill.

7. The invention according to claim 1 and, an end sill extending from opposite sides of a center sill and connected to said bearing arms adjacent to said juncture.

* * * * *